US005760659A

United States Patent [19]

Harrison et al.

[11] Patent Number: 5,760,659

[45] Date of Patent: Jun. 2, 1998

[54] MICROWAVE POLARISER

[75] Inventors: David Harrison, La Bouexiere; Chaoying Guo, Rennes, both of France

[73] Assignee: Thomson multimedia S.A., Courbevoie, France

[21] Appl. No.: 658,096

[22] Filed: Jun. 4, 1996

[30] Foreign Application Priority Data

Aug. 3, 1995 [EP] European Pat. Off. ..... 95401826

[51] Int. Cl.[6] ..... H01P 5/107

[52] U.S. Cl. ..... 333/125; 333/137; 333/21 A; 333/26

[58] Field of Search ..... 333/125, 137, 333/21 A, 26

[56] References Cited

U.S. PATENT DOCUMENTS 4,158,183 6/1979 Wong et al. ..... 333/21 A

FOREIGN PATENT DOCUMENTS 4207503 9/1993 Germany .
4305906 9/1994 Germany .
53-72552 6/1978 Japan .
54-13752 2/1979 Japan .
2-285702 11/1990 Japan .
2235340 2/1991 United Kingdom .

OTHER PUBLICATIONS

International Journal of Electronics, vol. 47, No. 5, Nov. 1979 London, GB, pp. 525–527 Joglekar et al. "A Rectangular Waveguide Orthomode Transducer".

19th European Convference, 4–7 Sep. 1989 London(GB) pp. 543–548 J. Modelski et al. "Integrated Input Circuit For Satellite Converter" p. 544.

*Primary Examiner*—Paul Gensler

*Attorney, Agent, or Firm*—Joseph S. Tripoli; Frederick A. Wein; Peter M. Emanuel

[57] ABSTRACT

A microwave polarizer particularly in a system for coupling energy between a waveguide and a transmission line. The polarizer reduces cross polarization by means of the probes being adjusted to an input impedance of less than 50 ohms, in particular to 20 ohms, by reducing the penetration depth of the probes. The smaller penetration depth also increases the distance between the two probes, which reduces cross polarization.

13 Claims, 1 Drawing Sheet

MICROWAVE POLARISER

Figure 1A:
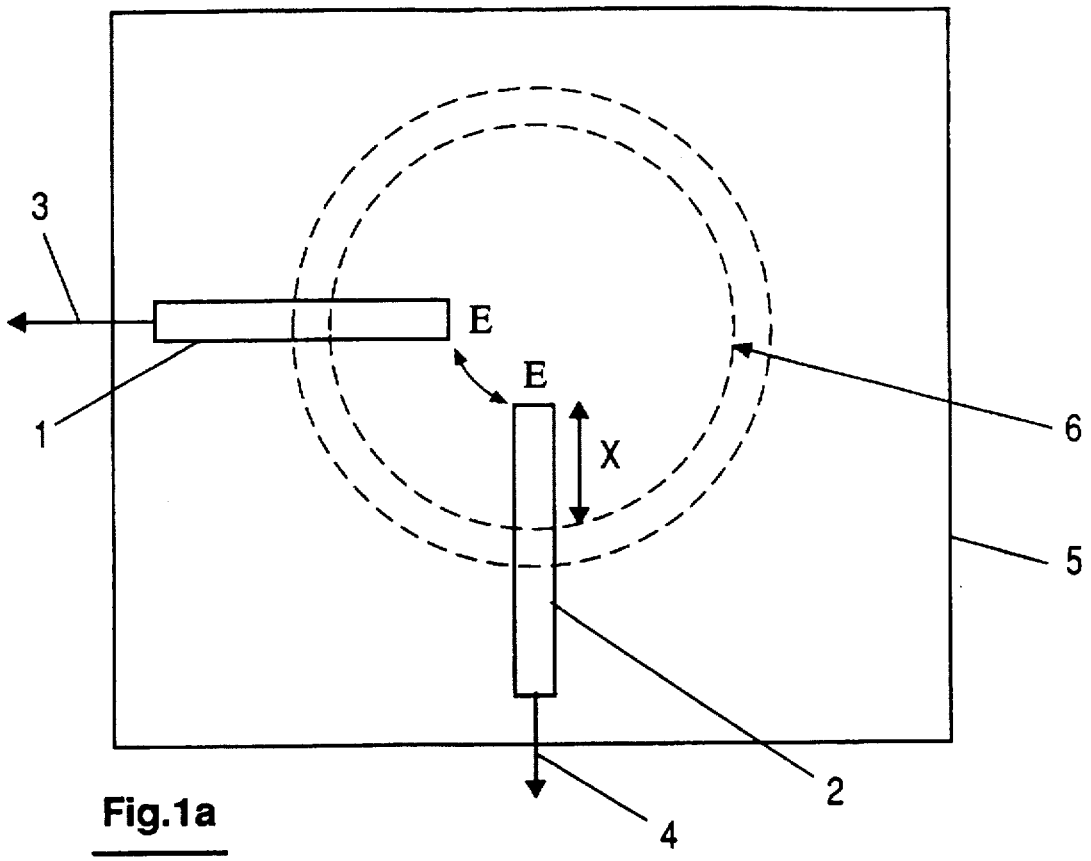

This invention relates to a microwave polariser and particularly to a microwave polariser for coupling energy between a waveguide and a transmission line or vice versa.

Coupling of energy between a waveguide and a transmission line leading to an amplifier is usually achieved by the use of one or more wire probes inserted into the waveguide cavity through the wall of the waveguide, so that the probes are lying transverse to its axis. In the case of a waveguide accommodating circular polarisation two such probes are required to be mutually orthogonal within the cavity. Those probes can be spaced from one another a prescribed distance, normally one wavelength, in the direction of the axis or can be arranged in a common plane orthogonal to the waveguide axis. These polarisers for circular polarisation are often used for receiving of television signals by satellites where often different polarisations for different channels are employed. This means that at the receiver channels with the same frequency but different circular polarisations can be selected. Therefore, one frequency of transmission can be used for a number of different channels. This means in a microwave polariser, for example known from EP-A-0350324, one circular polarisation will appear only at the output of probe 1 wherein the other polarisation will appear only at the output of probe 2. In practice, however, due to the coupling between the probes, a small amount of the received signal at one probe will also appear at the output of the other probe. In other words, the cross polarisation performance of the known polarisers is poor and a matching circuit is needed between the probes and the low noise amplifier, wherein the probes normally are adjusted to an impedance of 50 ohms.

It is therefore an object of the present invention to provide a microwave polariser for coupling energy between a waveguide and a transmission line, wherein the cross polarisation is improved and matching circuits are simplified or become unnecessary.

This object is solved by the features of the independent claim.

Further preferred embodiments of the invention are given in the dependent claims.

To improve the cross polarisation of the microwave polariser the length of the probes x, penetrating into the waveguide, are reduced to reduce the coupling between the probes. This also has the effect of reducing their input impedance. Normally the signal collected by the probes is amplified using a low noise HEMT amplifier. To optimise the performance of this amplifier it is necessary to terminate its input with a certain impedance level. Fortunately for HEMT amplifiers the resistive part of the impedance is less than 50 ohms, typically 20 ohms. This can be achieved by shortening the length of the probes, penetrating into the waveguide. This has the further advantage, that normally no matching network is necessary between the probes and the input of the amplifier to optimize the noise performance of the amplifier, which was the case in the previous state of the art.

The microwave polariser according to the invention for coupling energy between a waveguide and a transmission line connected to an amplifier, especially a low noise amplifier, comprises two orthogonal probes arranged in a plane orthogonal to the axis of the waveguide and penetrating a length x into the waveguide, wherein the penetration depth x of the probes is set to a value corresponding to an impedance value smaller than 50 ohms, in particular to an impedance value corresponding to 20 ohms.

Further the two mutually orthogonal probes are mounted on a common microwave substrate and are etched on the surface of said microwave substrate Further the microwave receiving/sending arrangement of this invention uses a polariser according to the invention and this microwave polariser is sandwiched between a circular waveguide and a circular lambda/4 short circuit cavity. The microwave travelling in the waveguide is supplied by the feed of the antenna. The probe signals picked up by the polariser are then amplified by a HEMT amplifier.

To further improve the performance of the amplifier and to achieve the necessary resistive part of the impedance at the input of the amplifier, the length of the short circuit cavity can be adjusted properly.

Figure 1B:
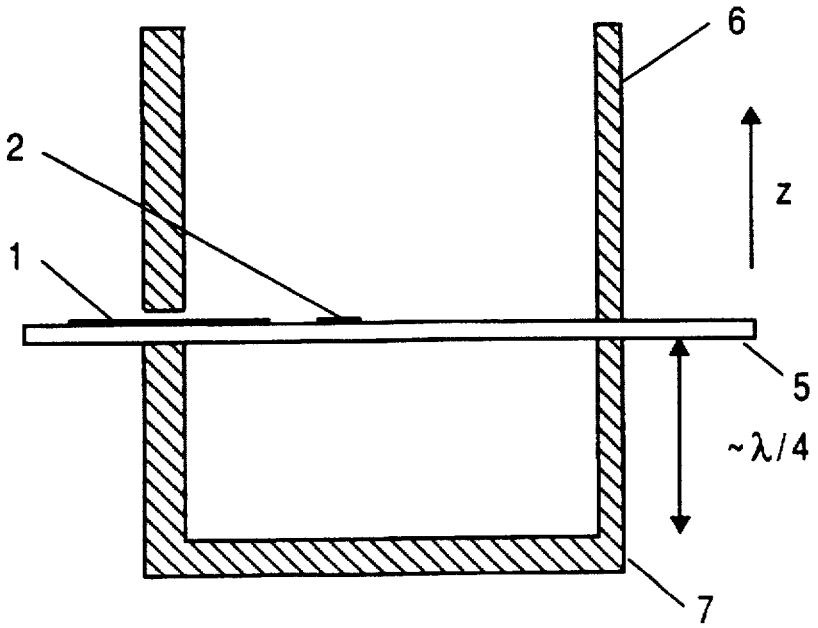

An embodiment of the microwave polariser according to the invention will now be described by way of example with reference to the accompanying drawing, in which:

FIG. 1*a* shows a cross section of the polariser according to the invention, and FIG. 1*b* shows a an elevational cross section of a polariser mounted between a waveguide and a short circuit cavity.

FIG. 1*a* shows an end view of the microwave polariser according to the invention. Two probes 1 and 2 are provided mutually orthogonal to each other on a microwave substrate 5. The probes 1 and 2 are connected via, for example, microwave strips 3, 4 to an amplifier (not shown). The probes 1, 2 penetrate a depth x into the space provided by a waveguide 6. The two end points of the probes E—E are spaced by a distance, wherein the cross polarisation (i.e. cross talk) increases when the distance between the two tips of the probes decreases. The penetration depth x according to the invention is chosen so that the input impedance of the respective strobe is smaller than 50 ohms, preferably 20 ohms.

FIG. 1*b* shows a sectional plane view of the receiving/sending arrangment, with a polariser comprising probes 1, 2 and a substrate 5, which is sandwiched between a waveguide 6 and a short circuit cavity 7. This short circuit cavity 7 is preferably approximately a quarter of a wavelength long. In particularly the length of the short circuit cavity is optimized according to the input impedance of the probes 1, 2. The amplifier used is preferably of HEMT type. For example, in the usual case of the $TE_{11}$ mode propagating in the waveguide, where it can be assumed that the signal arriving from the satellite via the feed is polarised such that its electric field is perpendicular to probe 1, ideally the signal will appear only at the output of probe 2. In practice, however, if in conventional systems the depth of penetration of the probes 1, 2 is set to provide a 50 ohms output impedance., the distance of the two points E is so close, that due to the coupling between the probes a small amount of the signal will also appear at the output of probe 1. This coupling degrades the cross polarisation of the system. In order to improve the cross polarisation of this system, the penetration depth x is shortened so that the distance between the end points E of the two probes is increased, which reduces the coupling between the probes. This also has the effect of reducing the input impedance of the probes 1, 2. Normally, the signal collected by the probes 1, 2 is amplified using a low noise HEMT amplifier (not shown). To optimise the performance of this amplifier it is necessary to terminate its input with a certain impedance level. For HEMT amplifiers the resistive part of the impedance is less than 50 ohms, typically 20 ohms. This input impedance can be achieved by shortening the penetration depth x of the probes. For this reason a matching network between the probes and the input of the amplifier to optimise the noise performance of the amplifier is not necessary. This has the advantage that the network loss is omitted and the noise of the receiver is decreased. Further to improve the performance of the amplifier the length of the short circuit cavity should be properly adjusted. The probes are not restricted to probes etched on a microwave substrate, but any type of probe system in a circular waveguide is possible.

I claim:

1. Microwave polarizer for coupling energy between a waveguide and a transmission line, comprising:

two orthogonal probes arranged in a plane orthogonal to the axis of the waveguide and penetrating a predetermined depth into the waveguide, wherein in order to improve cross polarization performance, the penetration depth of the probes is set to a value corresponding to a reduced impedance value smaller than 50 ohms, and a low noise amplifier means coupled to the probes, said reduced impedance value matching an input impedance of said low noise amplifier means.

2. A microwave polarizer according to claim 1, wherein the penetration depth of the probes is set to an impedance value corresponding to 20 ohms.

3. A microwave polarizer according to claim 1 wherein the low noise amplifier means is an HEMT amplifier.

4. A microwave polarizer according to claim 1, wherein the two probes are mutually orthogonal and mounted on a common microwave substrate.

5. A microwave polarizer according to claim 4, wherein the two probes are etched on the surface of said microwave substrate.

6. A microwave polarizer according to claim 1 which is disposed between a circular waveguide and a circular $\lambda/4$ short circuit cavity.

7. A microwave polarizer according to claim 6, wherein the waveguide is supplied by a feed of an antenna.

8. A microwave receiving/sending arrangement using a polarizer for coupling energy between a waveguide and a transmission line, comprising:

two mutually orthogonal probes arranged in a plane orthogonal to an axis of the waveguide and penetrating a predetermined depth into the waveguide, the penetration depth of the probes being set to a value corresponding to an impedance value smaller than 50 ohms, and a low noise amplifier means coupled to the probes, the microwave polarizer being disposed between a circular waveguide and a circular $\lambda/4$ short circuit cavity.

9. An arrangement according to claim 8, wherein the penetration depth of the probes is set to an impedance value corresponding to 20 ohms.

10. An arrangement according to claim 8 wherein the low noise amplifier means is an HEMT amplifier.

11. An arrangement according to claim 8, wherein the two probes are mutually orthogonal and mounted on a common microwave substrate.

12. An arrangement according to claim 11, wherein the two probes are etched on the surface of said microwave substrate.

13. An arrangement according to claim 8, wherein the waveguide is supplied by a feed of an antenna.

* * * * *